US009129737B2

(12) United States Patent
Yokoyama et al.

(10) Patent No.: US 9,129,737 B2
(45) Date of Patent: Sep. 8, 2015

(54) LAMINATED INDUCTOR

(71) Applicant: TAIYO YUDEN CO., LTD., Taito-ku, Tokyo (JP)

(72) Inventors: Ichirou Yokoyama, Takasaki (JP); Taisuke Suzuki, Takasaki (JP); Masuo Yatabe, Takasaki (JP); Tomoyuki Oyoshi, Takasaki (JP); Noriyuki Mabuchi, Takasaki (JP); Kazuhiko Oyama, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 14/228,878

(22) Filed: Mar. 28, 2014

(65) Prior Publication Data

US 2014/0292470 A1 Oct. 2, 2014

(30) Foreign Application Priority Data

Mar. 29, 2013 (JP) ..... 2013-074885
Mar. 15, 2014 (JP) ..... 2014-052854

(51) Int. Cl.
*H01F 5/00* (2006.01)
*H01F 27/29* (2006.01)

(52) U.S. Cl.
CPC ..... *H01F 27/292* (2013.01); *H01F 5/00* (2013.01)

(58) Field of Classification Search
CPC ..... H01F 5/00; H01F 27/00–27/30
USPC ..... 336/65, 83, 200, 233–234
See application file for complete search history.

(56) References Cited

FOREIGN PATENT DOCUMENTS

| | | | |
|---|---|---|---|
| JP | 05326318 A | * | 12/1993 |
| JP | 06029144 A | * | 2/1994 |
| JP | 2011-109065 A | | 6/2011 |
| KR | 1020110018954 | | 2/2011 |
| KR | 101228752 | | 1/2013 |
| WO | WO 2010013843 A1 | * | 2/2010 |

OTHER PUBLICATIONS

An Office Action issued by the Korean Intellectual Property Office, mailed Feb. 11, 2015, for Korean counterpart application No. 1020140031424.

* cited by examiner

*Primary Examiner* — Tuyen Nguyen
(74) *Attorney, Agent, or Firm* — Law Office of Katsuhiro Arai

(57) ABSTRACT

A laminated inductor includes: a laminate having an insulating part constituted by non-magnetic layers, as well as a coil part constituted by conductors positioned between the non-magnetic layers; and external electrodes that are electrically connected to the ends of the coil part and positioned on the exterior surfaces of the laminate; wherein the external electrodes each have a first electrode layer whose primary constituent is Ag, as well as a second electrode layer whose primary constituent is Cu and which is positioned on the outer side of the first electrode layer and has a thickness of 4 μm or more, and the total thickness of the first electrode layer and second electrode layer is 5 μm or more and preferably 10 μm or less.

6 Claims, 4 Drawing Sheets

LAMINATED INDUCTOR

FIELD OF THE INVENTION

The present invention relates to a laminated inductor.

DESCRIPTION OF THE RELATED ART

General laminated inductors use Ag as their external electrodes. From the viewpoint of improving the ease of mounting by preventing solder leaching when Ag is soldered, it has been proposed that a barrier layer be formed with Ni plating and that Sn plating be provided further to ensure solderability. Any impact of external electrodes on electrical characteristics is minimal when the size of the component is relatively large, which has heretofore left the external electrodes out of the focus of study. As components became increasingly small with chips measuring 0.6 mm or shorter and 0.3 mm or narrower, however, Ni external electrodes would affect the high-frequency characteristics and certain product characteristics such as resistance. Given the situation, studies are being done to improve the ease of mounting, one example of which is to use Ag+Ni+Cu+CuSn alloy+Sn as proposed in Patent Literature 1.

BACKGROUND ART LITERATURES

[Patent Literature 1] Japanese Patent Laid-open No. 2011-109065

SUMMARY

Patent Literature 1, despite its claim that whiskers can be suppressed, is unable to accommodate thinner external electrode layers and higher frequencies. With the recent trends for higher frequencies, weaker signal electric fields, smaller products, etc., the impact of intermodulation distortion noise can no longer be ignored. An object of the present invention is to provide a laminated inductor capable of accommodating thinner external electrode layers and higher frequencies.

After studying in earnest, the inventors completed the present invention, the specifics of which are described below.

The laminated inductor proposed by the present invention comprises a laminate and external electrodes positioned on the exterior surfaces of the laminate. The laminate has an insulating part constituted by non-magnetic layers, and a coil part constituted by a conductor and positioned between the non-magnetic parts. The external electrodes electrically connect to the ends of the coil part. The external electrodes each have a first electrode layer whose primary constituent is Ag, and a second electrode layer whose primary constituent is Cu and which is positioned on the outer side of the first electrode layer as viewed from the laminate. The second electrode layer is 4 μm or thicker and the total thickness of the first electrode layer and second electrode layer is 5 μm or more and preferably 10 μm or less. The length of the laminated inductor (chip) is preferably 0.6 mm or less and the width is preferably 0.3 mm or less.

According to the present invention, an easy-to-mount inductor resistant to solder leaching can be obtained and better high-frequency characteristics achieved by using primarily Ag to form a first electrode layer corresponding to a base electrode, while using primarily Cu to form a second electrode layer positioned on the outer side of the first electrode layer, and by adjusting the total thickness of the first electrode layer and second electrode layer to 5 μm or more and the thickness of the second electrode layer to 4 μm or more. Particularly at the frequencies of above 2 GHz, ESR characteristics can be lowered and Q characteristics can also be raised further at the same time.

Any discussion of problems and solutions involved in the related art has been included in this disclosure solely for the purposes of providing a context for the present invention, and should not be taken as an admission that any or all of the discussion were known at the time the invention was made.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
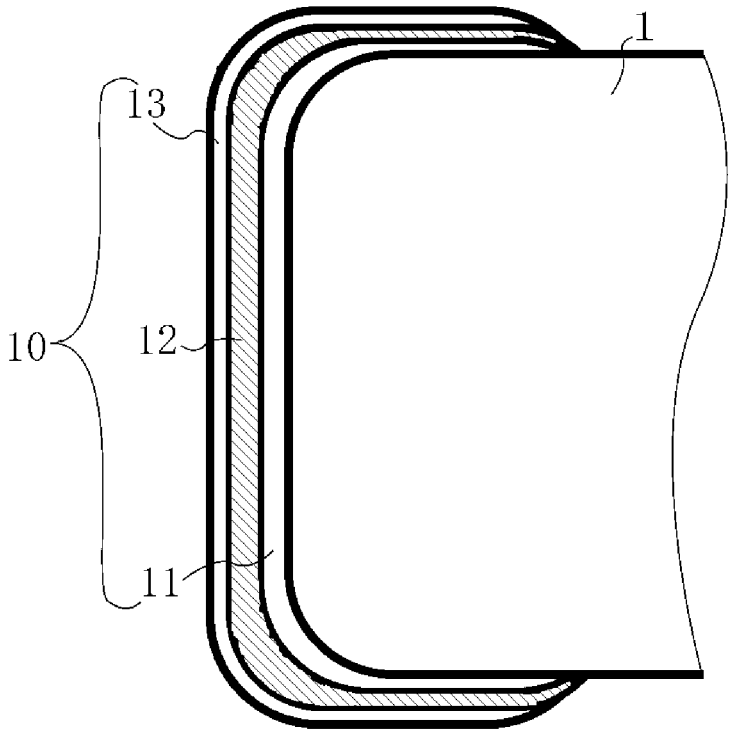
FIG. 1 is a schematic section view (along the z-axis) of a part a laminated inductor near an external electrode conforming to an example of the present invention.

1: Laminate
10: External electrode
11: First electrode layer
12: Second electrode layer
13: Third electrode layer
A21 to A29: Insulator layer
B21 to B26: Conductor pattern
C21 to C25: Via hole conductor

DETAILED DESCRIPTION OF EMBODIMENTS

The present invention is described in detail below by referring to the drawings as deemed appropriate. Note, however, that the present invention is not limited to the illustrated embodiments and that the scale of each part of the drawings may not be always accurate as characteristic parts of the invention may be emphasized in the drawings.

FIG. 1 is a partial schematic section view around the external electrodes in an example of a laminated inductor conforming to the present invention. The laminated inductor conforming to the present invention has a laminate 1 and external electrodes 10 positioned on the exterior surfaces of the laminate 1. The external electrodes 10 each have at least a first electrode layer 11 and second electrode layer 12, arranged in that order from the closest to the laminate 1.

The first electrode layer 11 is primarily constituted by Ag. The content of Ag in the first electrode layer is 5 percent by mol or more, for example, or preferably 50 percent by mol or more, or more preferably 90 percent by mol or more, or yet more preferably the first electrode layer is entirely constituted by Ag except for unavoidable impurities. The elements that may be contained in the first electrode layer 11, other than Ag, include Pd, Si, B, and Al, among others, which may form an alloy with Ag, or glass is contained to increase the bonding force with the laminate. The first electrode layer 11 is preferably in direct contact with the laminate. The thickness of the first electrode layer 11 is not limited in any way and a favorable range can be specified based on relationship described later regarding the total thickness with the second electrode layer 12.

The second electrode layer 12 is primarily constituted by Cu. The content of Cu in the second electrode layer is 5 percent by mol or more, for example, or preferably 50 percent by mol or more, or more preferably 75 percent by mol or more, or yet more preferably the second electrode layer is entirely constituted by Cu except for unavoidable impurities. The elements that may be contained in the second electrode layer 12, other than Cu, include Sn or the like, which preferably form an alloy with Cu. The second electrode layer 12 is preferably in direct contact with the first electrode layer 11.

The thickness of the second electrode layer 12 is 4 μm or more, or preferably 5 μm or more. The maximum thickness of the second electrode layer is not limited in any way and a favorable range can be specified based on the relationship described later regarding the total thickness with the first electrode layer 11.

The total thickness of the first electrode layer 11 and second electrode layer 12 is 5 μm or more, or preferably 6 to 10 μm. The greater the total thickness of the two layers 11, 12, the lower the chances of solder leaching occurring and high-frequency characteristics deteriorating, while a smaller total thickness of the two layers 11, 12 is preferable from the viewpoint of reducing the device size. In particular, a high Q value can be obtained preferably by making the thickness of the second electrode layer 12 greater than the thickness of the first electrode layer 11, or more preferably by adjusting the ratio of the thickness of the first electrode layer 11 to the thickness of the second electrode layer 12 to between 0.1 and 0.4.

In the embodiment shown in FIG. 1, another electrode layer 13 (hereinafter referred to as the "third electrode layer") is provided on the outer side of the second electrode layer 12. As shown, the external electrode 10 can have not only the first electrode layer 11 and second electrode layer 12, but also at least one more electrode layer. The constituent element of the third electrode layer 13 may be Sn, for example. When the third electrode layer 13 is provided, its thickness is preferably 1 μm or more, or more preferably 1 to 5 μm.

The thickness of each electrode layer can be measured by observing a section near the center of the external electrode 10 using an optical microscope.

According to the present invention, preferably Ni is not contained in the external electrode 10. To be specific, the content of Ni is preferably 17 percent by weight or less, or more preferably 5 percent by weight or less in all layers of the external electrode 10, or yet more preferably Ni is not contained at all except for unavoidable impurities. Minimization of Ni in the external electrode 10 improves the high-frequency characteristics. Particularly when the laminated inductor is for high-frequency use, its ESR characteristics decrease while its Q characteristics become higher than they normally are. Here, the laminated inductor for high-frequency use refers to, for example, a laminated inductor constituted for use at frequencies above 2 GHz.

Figure 2:
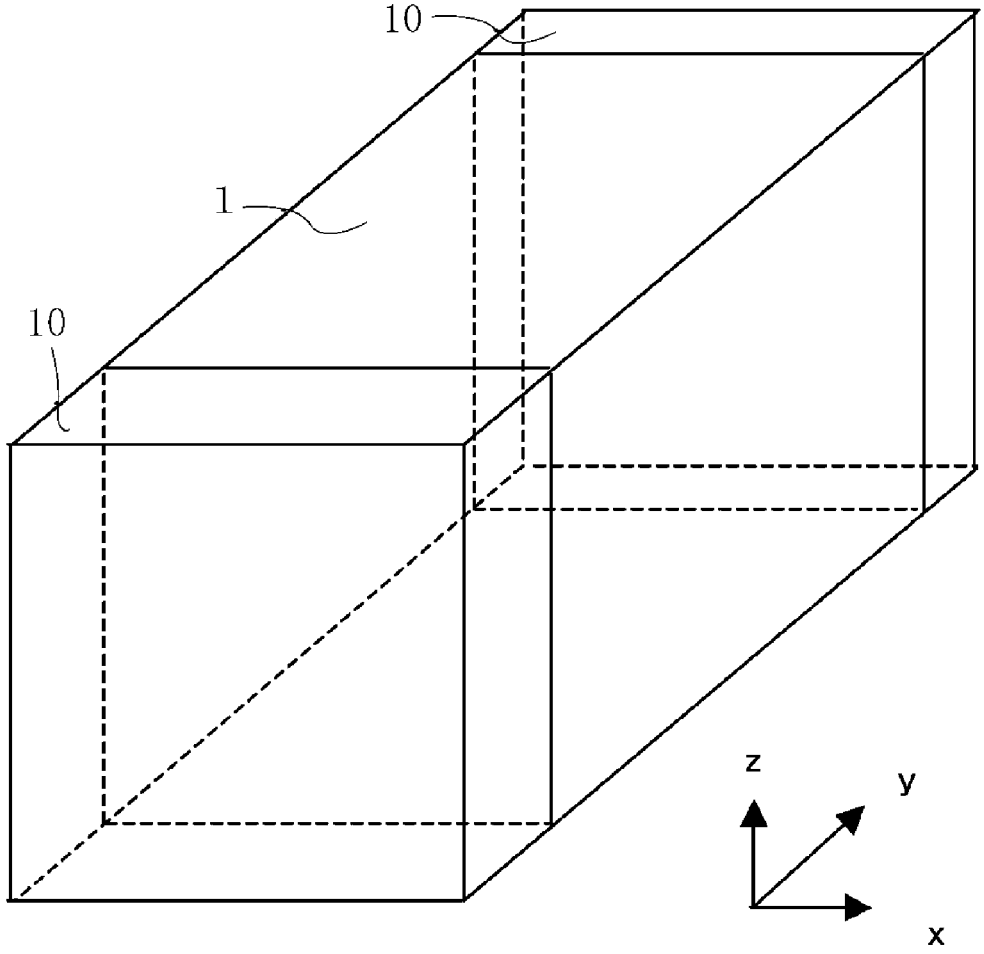
FIG. 2 is a schematic perspective view of a laminated inductor conforming to an example of the present invention.
Figure 4:
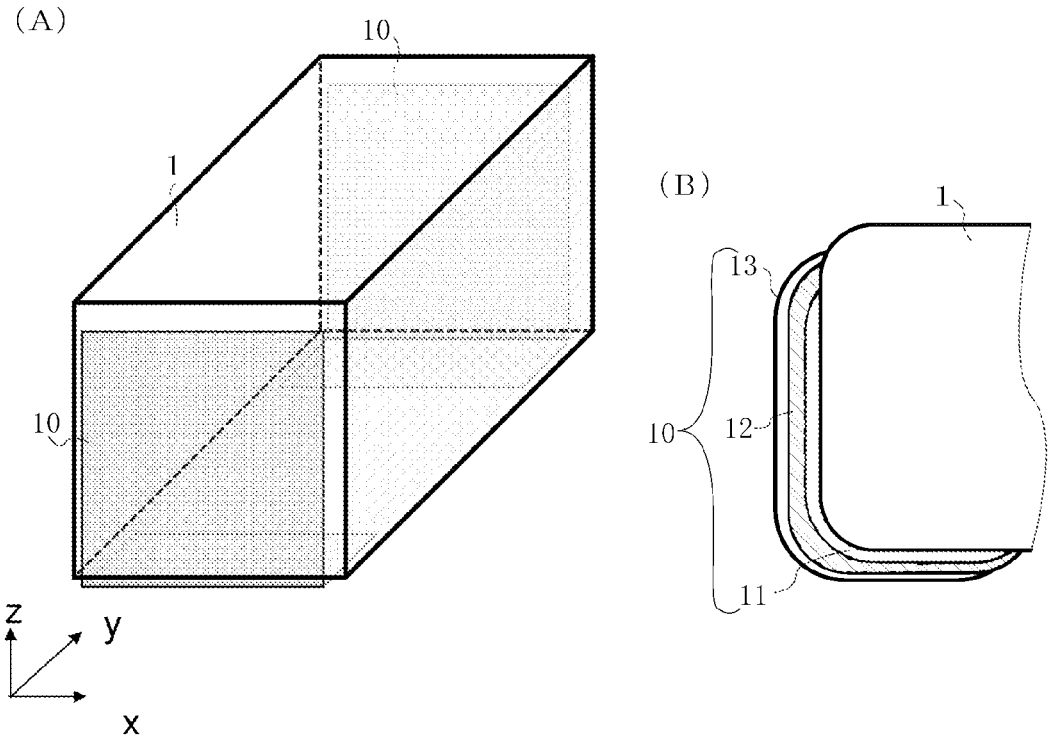
FIG. 4 consists of (A) a schematic perspective view of an example of a laminated inductor conforming to the present invention, and (B) a schematic section view (along the z-axis) of a part of the laminated inductor near the external electrode.

FIG. 2 is a perspective schematic view of an example of a laminated inductor conforming to the present invention. The laminated inductor shown in FIG. 2 has a rectangular solid laminate 1 and external electrodes 10 provided on a pair of exterior surfaces thereof. The layer structure of the external electrodes 10 is as described above. The specific method for forming the external electrodes 10 is not limited in any way and any traditionally known means for forming electrodes can be applied as deemed appropriate. Examples of such means include electroplating, non-electroplating, deposition, and application, followed by baking, of a paste containing constituent metals. FIG. 4 provides schematic views of an example of laminated inductor conforming to the present invention. (A) in FIG. 4 is a perspective schematic view, while (B) in FIG. 4 is a partial schematic section view near an external electrode. The external electrode 10 need not have a shape that completely covers the end of the product, and the effects of the present invention can still be achieved with the shape shown in FIG. 4. Refer to the description of "Examples" later for examples of specific forming methods.

The laminate 1 of the laminated inductor has a coil part constituted by a conductor, as well as an insulating part around it, where the specific constitution can be designed as deemed appropriate according to the purpose by referring to any traditionally known art. The ends of the coil part electrically connect to the external electrodes 10. The insulating part can use, without specific limitations, any material whose primary constituent is glass, or any ferrite, dielectric ceramics, etc., while the conductor constituting the coil part may use Ag, Cu or any alloy containing Ag/Cu, etc., as deemed appropriate.

The method for manufacturing the laminate 1 is not limited in any way and examples include printing a metal-containing paste which is a precursor to the coil part on a green sheet which is a precursor to the insulating part in a specified shape, providing a through hole if necessary, and then stacking and pressure-bonding the printed green sheets, followed by heating and/or sintering, to obtain the insulating part from the green sheet and also to obtain the coil part from the printed paste. Refer to the description of "Examples" later for examples of specific manufacturing methods.

The shape of the laminated inductor manufactured according to the present invention is not limited in any way, but preferably it is a rectangular parallelepiped. The section vertical to the laminating direction of the laminated inductor is preferably a quadrate, where the length of the long side of the quadrate is preferably 0.4 to 0.6 mm, while the length of the short side is preferably 0.2 to 0.3 mm. If the quadrate is a square, preferably each side satisfies either one of the aforementioned conditions.

[Examples]

Figure 3:
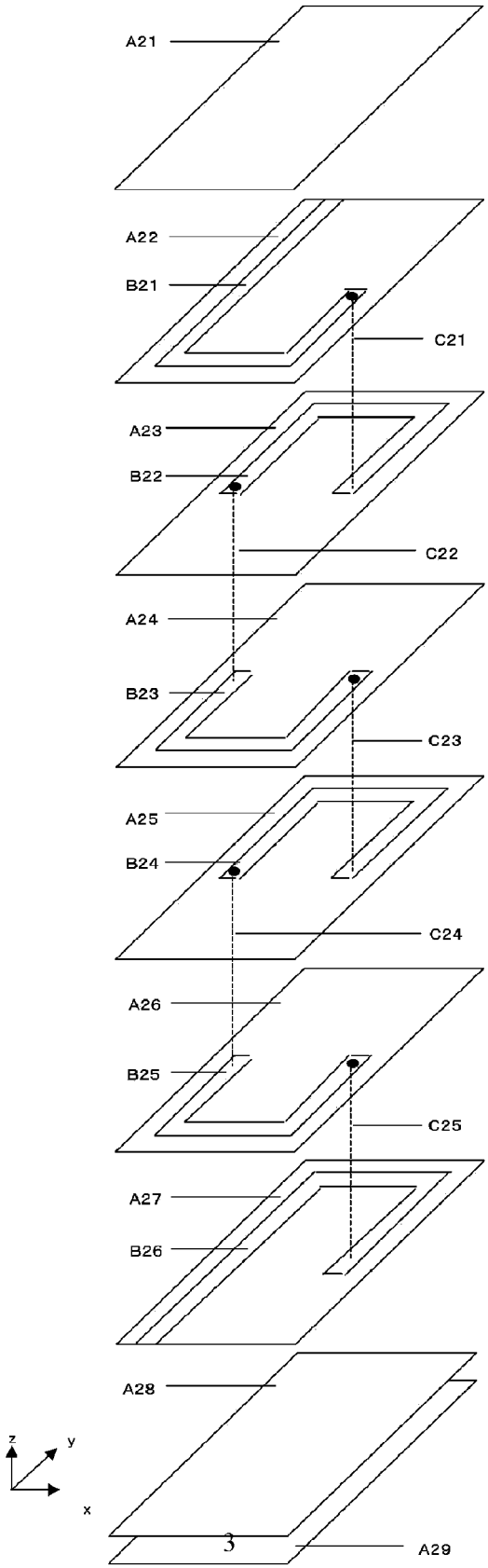
FIG. 3 is a schematic exploded view of a laminated inductor conforming to an example of the present invention.

More specific embodiments are explained below, but it should be noted that these explanations do not limit the present invention in any way. FIG. 3 is an exploded schematic view showing the layer structure of the laminate of the laminated inductor manufactured in an example. Here, the laminating direction of the laminate is defined as the z-axis direction, the direction along the short side of the laminate is defined as the x-axis direction, and the direction along the long side of the laminate is defined as the y-axis direction. The x-axis, y-axis, and z-axis cross at right angles to one another. The external electrodes (not illustrated) are provided in a manner covering the two side faces positioned at both ends in the y-axis direction. In the laminate, an insulating part is constituted by stacking insulator layers A21 to A29 in the z-axis direction. The insulator layers A21 to A29 are made by a material whose primary constituent is glass, and have a rectangular shape of 0.6 mm×0.3 mm, 1.0 mm×0.5 mm, or 0.4 mm×0.2 mm as examples and comparative examples, while the coil part is present between the insulating layers, extends in a spiral pattern that advances in the z-axis direction while turning, and contains conductor patterns B21 to B26 and via hole conductors C21 and C25. The conductor patterns B21 to B26 are respectively formed on the primary sides of the insulator layers A22 to A27, and stacked together with the insulator layers A21, A28 and A29. The coil part is constituted by Ag. The conductor patterns B21 and B26 are leaders. The conductor patterns B21 and B26 are connected to the external electrodes, respectively. The respective conductor patterns are connected by the via hole conductors C21 to C25.

In manufacturing this laminated inductor, first a slurry containing glass material was applied on films using the doctor blade method to form green sheets of 18 μm in thickness. Next, through holes were formed by laser processing at the specified positions, or specifically positions where the via hole conductors C21 to C25 would be formed, on the green sheets. Then, a silver paste was printed by means of screen-masking in the specified positions on the green sheets that would become the insulator layers A22 to A27. Subsequently, the green sheets that would become the insulator layers A21 to A29 were stacked in the order shown in FIG. 3 and then pressure was applied in the laminating direction to pressure-bond the green sheets. The pressure-bonded green sheets were then cut to the unit size of the chip and sintered at 800° C. to 900° C. to form a laminate.

External electrodes were formed in a manner covering the two side faces positioned at both ends of the obtained laminate in the y-axis direction. First, an Ag paste or AgPd alloy paste was applied and baked at 680° C. to 900° C. to form a first electrode layer 11. When an AgPd alloy was used, the content of Ag was 10 percent by mol.

Next, the first electrode layer 11 was electroplated to obtain a second electrode layer 12. Electroplating was implemented in the form of either Cu plating or Ni plating. Cu plating was implemented in the form of barrel plating where power was supplied at 0.4 A/dm$^2$ in a copper plating bath containing aqueous Cu salt solution kept at 50° C. The thickness of the Cu plating layer was controlled by the duration of power supply (30 to 120 minutes) for barrel plating. Ni plating was implemented in the form of barrel plating where power was supplied at 0.2 A/dm$^2$ in a copper plating bath containing aqueous Ni salt solution kept at 50° C. The thickness of the Ni plating layer was controlled by the duration of power supply for barrel plating.

After forming the second electrode layer 12, a Sn layer (third electrode layer 13) of 3 μm in thickness was formed by means of barrel plating with power supplied for 60 minutes at 0.1 A/dm$^2$ in aqueous Sn salt solution at room temperature. Also in Example 6, the CuSn alloy layer was formed by Cu-plating the second electrode layer 12 and Sn-plating the third electrode layer 13 and then heat-treating them at 150° C. for 1 hour. As a result, non-alloyed copper and copper-tin alloy coexist in the second electrode layer (thickness: 9.0 μm), which is hereinafter referred to as "Cu+CuSn alloy layer, 9.0 μm." This CuSn alloy had a Cu:Sn ratio of 3:1 (atom ratio).

The laminated inductors of examples and comparative examples were obtained this way.

The types and thicknesses of the first electrode layer and second electrode layer constituting the external electrodes of the laminated inductors in the examples and comparative examples are listed below. The thickness of each layer was obtained by observing a cut face near the center of the external electrode using an optical microscope and then taking the smallest of the values measured at five locations. The "thickness ratio" represents the ratio of the thickness of the first electrode layer to the thickness of the second electrode layer. The chip size was 0.6 mm×0.3 mm in Comparative Examples 1 to 3 and Examples 1 to 6, 1.0 mm×0.5 mm in Examples 7 and 8, and 0.4 mm×0.2 mm in Examples 9 and 10.

Comparative Example 1: First electrode layer (Ag layer, 1.1 μm), second electrode layer (Ni layer, 3.9 μm), thickness ratio (0.28)

Comparative Example 2: First electrode layer (Ag layer, 1.1 μm), second electrode layer (Ni layer, 5.8 μm), thickness ratio (0.19)

Comparative Example 3: First electrode layer (Ag layer, 5.0 μm), second electrode layer (Cu layer, 3.0 μm), thickness ratio (1.67)

Example 1: First electrode layer (Ag layer, 1.0 μm), second electrode layer (Cu layer, 4.0 μm), thickness ratio (0.25)

Example 2: First electrode layer (Ag layer, 2.0 μm), second electrode layer (Cu layer, 5.0 μm), thickness ratio (0.40)

Example 3: First electrode layer (Ag layer, 2.0 μm), second electrode layer (Cu layer, 8.0 μm), thickness ratio (0.25)

Example 4: First electrode layer (Ag layer, 4.0 μm), second electrode layer (Cu layer, 7.0 μm), thickness ratio (0.57)

Example 5: First electrode layer (AgPd alloy layer, 2.0 μm), second electrode layer (Cu layer, 5.0 μm), thickness ratio (0.40)

Example 6: First electrode layer (Ag layer, 0.9 μm), second electrode layer (Cu+CuSn alloy layer, 9.0 μm), thickness ratio (0.10)

Example 7: First electrode layer (Ag layer, 1.1 μm), second electrode layer (Cu layer, 4.0 μm), thickness ratio (0.28)

Example 8: First electrode layer (Ag layer, 3.0 μm), second electrode layer (Cu layer, 4.0 μm), thickness ratio (0.75)

Example 9: First electrode layer (Ag layer, 1.1 μm), second electrode layer (Cu layer, 4.0 μm), thickness ratio (0.28)

Example 10: First electrode layer (Ag layer, 2.5 μm), second electrode layer (Cu layer, 4.0 μm), thickness ratio (0.63)

The laminated inductors in the examples and comparative examples were measured for the value of direct-current resistance R and that of Q at an inductance of 1 nH using a RF impedance analyzer. Also, according to JIS C60068-2-58: 2006, 8.2.1, the external electrodes 10 were given flux treatment (using rosin 25% solution), and then soaked in a solder (Sn—3Ag—0.5Cu) at 260° C. for 10 seconds to remove the flux, after which a section of the external electrode 10 was observed with a magnifying glass of approx. 20 to 30 magnifications to check the ratio of eroded area, and a score of "○" was given when the area of the external electrode remaining intact without solder leaching was 75% of the entire area or more on all 10 measured samples, and a score of "x" was given when this area was less than 75% on any one of the samples.

The aforementioned R values, Q values, and evaluation results of "solder quality" of the laminated inductors in the examples and comparative examples are listed below.

Comparative Example 1: R value (262.1 mΩ), Q value (54.2), solder quality (○)

Comparative Example 2: R value (261.0 mΩ), Q value (55.1), solder quality (○)

Comparative Example 3: R value (190.4 mΩ), Q value (68.0), solder quality (X)

Example 1: R value (212.2 mΩ), Q value (77.9), solder quality (○)

Example 2: R value (195.2 mΩ), Q value (78.1), solder quality (○)

Example 3: R value (186.8 mΩ), Q value (74.3), solder quality (○)

Example 4: R value (183.1 mΩ), Q value (66.8), solder quality (○)

Example 5: R value (201.2 mΩ), Q value (75.1), solder quality (○)

Example 6: R value (208.1 mΩ), Q value (72.6), solder quality (○)

Example 7: R value (205.3 mΩ), Q value (78.5), solder quality (○)

Example 8: R value (203.7 mΩ), Q value (74.3), solder quality (○)

Example 9: R value (378.7 mΩ), Q value (38.8), solder quality (○)

Example 10: R value (369.1 mΩ), Q value (30.0), solder quality (○)

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, an article "a" or "an" may refer to a species or a genus including multiple species, and "the invention" or "the present invention" may refer to at least one of the embodiments or aspects explicitly, necessarily, or inherently disclosed herein. In this disclosure, any defined meanings do not necessarily exclude ordinary and customary meanings in some embodiments. For example, the term "constituted by" refers to "comprising", "consisting essentially of", or "consisting of" in some embodiments.

The present application claims priorities to Japanese Patent Application No. 2013-074885, filed Mar. 29, 2013, and No. 2014-052854, filed Mar. 15, 2014, each disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A laminated inductor comprising:

a laminate having an insulating part constituted by non-magnetic layers, as well as a coil part constituted by conductors positioned between the non-magnetic layers; and external electrodes that are electrically connected to ends of the coil part and positioned on exterior surfaces of the laminate;

wherein the external electrodes each have a first electrode layer whose primary constituent is Ag, as well as a second electrode whose primary constituent is Cu and which is positioned on an outer side of the first electrode layer and has a thickness of 4 μm or more, and a total thickness of the first electrode layer and second electrode layer is 5 μm or more, said second electrode consisting of metal including Cu without Ni, and unavoidable impurities if any.

2. A laminated inductor according to claim 1, wherein the total thickness of the first electrode layer and second electrode layer is 10 μm or less.

3. A laminated inductor according to claim 1, wherein a section vertical to a laminating direction has a quadrate shape with a long side of 0.6 mm or less and a short side of 0.3 mm or less.

4. A laminated inductor according to claim 2, wherein a section vertical to a laminating direction has a quadrate shape with a long side of 0.6 mm or less and a short side of 0.3 mm or less.

5. A laminated inductor according to claim 1, wherein the second electrode is an electroplated layer of the first electrode.

6. A laminated inductor according to claim 1, wherein the second electrode has a thickness greater than the first electrode.

* * * * *